US010028066B2

(12) United States Patent
Schmidt et al.

(10) Patent No.: US 10,028,066 B2
(45) **Date of Patent: *Jul. 17, 2018**

(54) HEARING AID CONFIGURATION DETECTION

(71) Applicant: GN Hearing A/S, Ballerup (DK)

(72) Inventors: Flemming Schmidt, Virum (DK); Ebbe Skammelsen, Horsholm (DK)

(73) Assignee: GN Hearing A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 14/751,894

(22) Filed: Jun. 26, 2015

(65) Prior Publication Data

US 2016/0360328 A1 Dec. 8, 2016

(30) Foreign Application Priority Data

Jun. 3, 2015 (DK) ..... 2015 70340
Jun. 3, 2015 (EP) ..... 15170464

(51) Int. Cl.
*H04R 25/00* (2006.01)

(52) U.S. Cl.
CPC ..... *H04R 25/70* (2013.01); *H04R 25/558* (2013.01); *H04R 2225/51* (2013.01)

(58) Field of Classification Search
USPC ..... 381/312, 314
See application file for complete search history.

(56) References Cited

U.S. PATENT DOCUMENTS

| | | | |
|---|---|---|---|
| 5,659,621 | A | 8/1997 | Newton |
| 6,269,318 | B1 | 7/2001 | Geddes |
| 6,712,754 | B2 | 3/2004 | Miller et al. |
| 6,859,538 | B1 | 2/2005 | Voltz |
| 6,934,400 | B1 | 8/2005 | Vonlanthen |
| 7,064,957 | B1 | 6/2006 | Liang et al. |
| 7,286,678 | B1 | 10/2007 | Bachler et al. |
| 8,027,496 | B2 | 9/2011 | Bachler et al. |
| 8,433,072 | B2 | 4/2013 | Muller et al. |

(Continued)

FOREIGN PATENT DOCUMENTS

| | | |
|---|---|---|
| DE | 10 2008 03055 | 8/2009 |
| EP | 1 701 585 | 9/2006 |

(Continued)

OTHER PUBLICATIONS

Extended European Search Report dated Nov. 17, 2015, for corresponding European Patent Application No. 15170464.0, 8 pages.

(Continued)

*Primary Examiner* — Quoc D Tran
(74) *Attorney, Agent, or Firm* — Vista IP Law Group, LLP

(57) ABSTRACT

A hearing aid includes: a first module accommodating first circuitry; a second module accommodating second circuitry; and an interconnecting member configured for interconnecting the first circuitry with the second circuitry; wherein the second circuitry comprises a memory for storing data relating to a configuration of the second module including the second circuitry, and data communication circuitry configured for transmission of the data relating to the configuration from the memory to the first circuitry.

28 Claims, 5 Drawing Sheets

(56) References Cited

U.S. PATENT DOCUMENTS

| | | | | |
|---|---|---|---|---|
| 8,467,553 | B2 * | 6/2013 | Schefer | H04R 25/305 381/312 |
| 2002/0015506 | A1 | 2/2002 | Aceti et al. | |
| 2002/0026091 | A1 | 2/2002 | Leysieffer | |
| 2003/0086582 | A1 | 5/2003 | Vonlanthen | |
| 2007/0019817 | A1 | 1/2007 | Siltmann | |
| 2007/0286441 | A1 | 12/2007 | Harsch et al. | |
| 2008/0008340 | A1 * | 1/2008 | Bachler | H04R 25/305 381/314 |
| 2009/0010467 | A1 | 1/2009 | Ritter et al. | |
| 2009/0028364 | A1 | 1/2009 | Vonlanthen | |
| 2009/0052706 | A1 * | 2/2009 | Gottschalk | H04R 25/305 381/314 |
| 2009/0103754 | A1 | 4/2009 | Gottschalk et al. | |
| 2009/0196444 | A1 * | 8/2009 | Solum | H01Q 1/273 381/315 |
| 2010/0067707 | A1 * | 3/2010 | Schwerdtner | H04R 25/552 381/23.1 |
| 2010/0111315 | A1 * | 5/2010 | Kroman | H04R 25/305 381/60 |
| 2010/0158291 | A1 * | 6/2010 | Polinske | H04R 25/554 381/315 |
| 2010/0232612 | A1 * | 9/2010 | Basseas | H04R 25/305 381/60 |
| 2012/0148054 | A1 | 6/2012 | Rank et al. | |
| 2013/0329926 | A1 | 12/2013 | Sacha | |
| 2015/0078599 | A1 * | 3/2015 | Sundberg | H04R 25/554 381/315 |
| 2015/0131831 | A1 * | 5/2015 | Akdeniz | H04R 25/554 381/315 |
| 2015/0237450 | A1 * | 8/2015 | Schmidt | H04R 25/70 381/314 |
| 2016/0112811 | A1 * | 4/2016 | Jensen | H04R 5/033 381/17 |

FOREIGN PATENT DOCUMENTS

| | | |
|---|---|---|
| WO | WO 1999/009799 | 3/1999 |
| WO | WO 2002/011509 | 2/2002 |
| WO | WO 2006/071210 | 7/2006 |
| WO | WO 2007/045254 | 4/2007 |
| WO | WO 2009/006889 | 1/2009 |

OTHER PUBLICATIONS

Non-final Office Action dated Jul. 17, 2012 for U.S. Appl. No. 12/743,211, 11 pages.

Notice of Allowance and Fee(s) due dated Dec. 28, 2012 for U.S. Appl. No. 12/743,211, 5 pages.

Communication pursuant to Article 94(3) EPC dated Jul. 15, 2016, for corresponding European Patent Application No. 15170464.0, 6 pages.

* cited by examiner

HEARING AID CONFIGURATION DETECTION

RELATED APPLICATION DATA

This application claims priority to and the benefit of Danish Patent Application No. PA 2015 70340 filed Jun. 3, 2015, pending, and European Patent Application No. 15170464.0 filed Jun. 3, 2015, pending. The entire disclosures of both of the above applications are expressly incorporated by reference herein.

FIELD OF TECHNOLOGY

The present disclosure relates to a new method for providing data relating to the configuration of a hearing aid, a hearing aid configured to perform the method, and a system for fitting a hearing aid utilizing the data relating to the configuration.

BACKGROUND

BTE (behind-the-ear) hearings aids are well-known in the art. A BTE hearing aid has a BTE housing that is shaped to be worn behind the pinna of a user. The BTE housing accommodates components for hearing loss compensation. An interconnecting member, i.e. a sound tube or an electrical conductor, transmits a signal representing the hearing loss compensated sound from the BTE housing into the ear canal of the user.

An output transducer of the BTE hearing aid may be a receiver positioned in the BTE hearing aid housing. In this event, the interconnecting member comprises a sound tube for propagation of acoustic sound signals from the receiver positioned in the BTE hearing aid housing and through the sound tube to an earpiece positioned and retained in the ear canal of the user and having an output port for transmission of the acoustic sound signal to the eardrum in the ear canal.

An output transducer of the BTE hearing aid may be a receiver positioned in an ear canal of the user of the hearing aid, a so-called Receiver-In-the-Ear. In the following, a hearing aid with a Receiver-In-the-Ear is denoted a RIE hearing aid.

In a RIE hearing aid, the interconnecting member comprises electrical conductors for propagation of hearing loss compensated audio sound signals from the hearing aid circuitry in the BTE hearing aid housing through the conductors to the receiver positioned in the ear canal of the user for emission of sound towards the eardrum of the user.

In order to position the receiver and/or the sound tube securely and comfortably in the ear canal of the user, an in-the-ear housing, earpiece, shell, or earmould may be provided for insertion into the ear canal of the user.

In the following, the terms in-the-ear-housing, earpiece, shell, and earmould are used interchangeably.

Typically, hearing aid manufacturers provide a number of different earpieces with receivers having different output power specifications, e.g. 5 different output power levels.

Typically, earpieces are also provided having interconnecting members of different lengths, e.g. 8 different lengths, to suit the individual anatomy of the intended user.

Thus, e.g., 8*5=40 different earpieces may be used together with a specific BTE-housing.

Additionally, in order to fit the user's ear and secure the interconnecting member and other components in their intended position in the ear canal and prevent the earpiece from falling out of the ear, e.g., when the user moves the jaw, the earpiece, shell, or earmould may be individually custom manufactured or may be manufactured in a number of standard sizes, which further multiplies the number of earpieces that may be used together with a specific BTE-housing.

The earpiece may further accommodate one or more microphones, e.g. a microphone used for suppressing the occlusion effect and/or one or more microphones for recording directional cues further multiplying the number of earpieces that may be used together with a specific BTE-housing.

This results in a very large variety of earpieces that can be used together with a specific BTE-housing.

SUMMARY

Thus, a large variety of hearing aids may be provided by provision of different combinations of a smaller number of different subassemblies. Therefore, there is a need for automatic detection of the actual configuration of each hearing aid.

Thus, a novel hearing aid is provided with a first module accommodating first circuitry, a second module accommodating second circuitry, and an interconnecting member configured for interconnecting the first circuitry with the second circuitry, and wherein the second circuitry comprises a memory for storing data relating to a configuration of the second module including the second circuitry, and data communication circuitry configured for transmission of data relating to the configuration from the memory to the first circuitry.

The novel hearing aid may be configured for adjusting its operation in accordance with the data relating to the configuration.

The second circuitry with the data communication circuitry may be configured for transmission of the data relating to the configuration to the first circuitry at the time of powering up the hearing aid; and/or upon the hearing aid receiving a user request for transmission of the data relating to the configuration, from a user interface of the hearing aid; and/or upon the hearing aid receiving a request for transmission of the data relating to the configuration, from external equipment, such as a fitting instrument.

The first circuitry may comprise a radio for wireless communication.

The radio may be connected to a conductor accommodated in the interconnecting member and forming an antenna, such as a monopole antenna; or, at least a part of an antenna, such as a dipole antenna.

The data communication circuitry may be configured for transmission of data via the conductor.

The second circuitry may include a power supply that is powered from the first circuitry.

The power supply may be powered utilizing the conductor. For example, the power supply may be charged by transmitting a high frequency signal f>20 kHz on the conductor.

The power supply may be a capacitor.

A novel method of configuring the novel hearing aid is also provided, comprising:

transmitting data stored in the memory utilizing the conductor forming at least part of the antenna.

A novel fitting instrument for fitting the novel hearing aid is also provided, configured for reception of the data relating to the configuration.

The novel fitting instrument may be configured for fitting the hearing aid based on the data relating to the configuration.

The novel fitting instrument may be configured for displaying a message in response to the data relating to the configuration.

The novel fitting instrument may be a dedicated instrument, or a PC with suitable fitting software, a hand-held device, e.g. a tablet computer, a smartphone, etc., with suitable apps, etc.

With automatic identification of a component, or a combination of components, e.g. a receiver in an earpiece, maladjustment of the hearing aid in question is avoided.

For example, faster and safer initial fitting can be performed by the dispenser due to the automatic identification of component(s), e.g. a receiver type, during the initial fitting of the hearing aid to the intended user, e.g. inadvertently exchanged left and right in-the-ear housings may be automatically detected. The dispenser is also relieved of the task of manually entering data relating to the configuration during fitting, and incorrect gain calibrations and output levels due to erroneously manually entered component information are avoided.

Further, malfunctioning of the hearing aid due to inadvertent undesired combination of components, such as inadvertent interconnection of a wrong in-the-ear housing to a BTE-housing, is avoided. For example, a boot process of the hearing aid may be stopped when an undesired combination of components is detected, and/or certain functions of the hearing aid may only be enabled if a combination of components suitable for performing the functions is detected.

Yet further, correct replacement part numbers may be easily identified for the hearing aid in question.

Still further, a user of the hearing may be warned of an incorrect combination of components, such as when left ear and right ear components are unintentionally exchanged, e.g. when an in-the-ear housing intended for the right ear is inadvertently connected to the BTE-housing fitted for the left ear. A user may also be warned if wrong replacement parts are inadvertently delivered to the user and used with the hearing aid, whereby the user may be saved annoyance and possible extra visits to the dispenser's office.

The automatic identification may be provided without increasing the number of conductors interconnecting the first and second circuitry, since the conductor used for transmission of the data relating to the configuration may already be present for another purpose, namely functioning as an antenna or as part of an antenna and/or for supplying power to the second circuitry. In this way, some existing hearing aid housings may be configured to operate as part of the new hearing aid without hardware modification, such as modification of interconnections with the interconnecting member. Also, complexity and cost of the interconnections are kept at a minimum.

The second circuitry may include a receiver.

An audio signal representing sound for transmission to a receiver positioned in the ear for emission of the sound towards an eardrum of the user may be transmitted utilizing another conductor that is not used for transmission of the data relating to the configuration.

The data relating to the configuration may include information identifying the particular arrangement of parts or components of the second circuitry.

In particular, the data relating to the configuration may include an identifier of a component, and/or a combination of components, of the second circuitry.

The data relating to the configuration may include an identifier of a combination of components of the second circuitry.

For example, earpieces may be provided, accommodating a) one receiver and zero microphones, b) one microphone and zero receivers, c) one receiver and one microphone positioned for preservation of directional cue, d) one receiver and one microphone positioned for suppressing occlusion, e) one receiver and two microphones positioned for preservation of directional cue and suppressing occlusion, etc.

The earpieces may further be provided with receivers with different power ratings, e.g. 4 different ratings, and may further have interconnecting members of different lengths, e.g. 5 different standard lengths.

Still further, earpieces may be provided configured for the left ear and earpieces may be provided configured for the right ear.

Yet still further, some earpieces may be provided with other sensors, such as temperature sensors, pressure sensors, directional sensors, blood pressure sensors, etc.

Thus, a large variety of ear pieces may easily be provided; and thus, automatic detection of the configuration of the second module currently connected to the BTE housing is highly advantageous, e.g. in order to avoid mistakes.

The fitting parameters of the hearing aid may be dependent on the component, or combination of components, of the second module, including the second circuitry.

Therefore, it is important to provide the correct combination of first and second circuitry of the hearing aid and fitting parameters of the hearing aid, for a specific user.

An incorrect combination may result in maladjustment of the hearing aid.

The first module may comprise a behind-the-ear housing and the second module may comprise an earpiece.

The second circuitry may include a microcontroller configured to control transmission of the data relating to the configuration.

BTE hearing aids, such as RIE hearing aids, may be provided with a connector for easy connection and disconnection of the second circuitry of the second module comprising the earpiece and the interconnecting member to the first circuitry of the first module comprising the BTE housing. Thus, the interconnecting member may be provided with a connector mating a corresponding connector of the BTE housing.

For example, in this way various types of receivers accommodated in respective earpieces may easily be connected to a BTE housing thereby providing different hearing aids with the same type of BTE housing but with different receivers.

The novel fitting instrument may automatically respond to received data relating to the configuration, e.g., by selecting hearing aid parameters in accordance with the received data relating to the configuration, e.g. a specific model of receiver identified. In this way, the receiver, the hearing aid and the hearing aid fitting parameters are combined correctly.

The operator of the novel fitting instrument may take appropriate action in response to a display of the data relating to the configuration, e.g., by adjusting hearing aid parameters in accordance with the data relating to the configuration, e.g. a specific model of receiver identified. In this way, the receiver, the hearing aid and the hearing aid fitting parameters are combined correctly.

The operator of the novel fitting instrument may take appropriate action in response to a display of the data relating to the configuration, e.g., by replacing the receiver, which is appropriate in case adjustment of the hearing aid to the specific model of receiver identified is not possible. In this way, undesired combinations of receiver, hearing aid and hearing aid fitting parameters can be discovered and corrected.

Adjustment of the hearing aid and hearing aid parameters may be controlled internally by the hearing aid.

Throughout the present disclosure, the "audio signal" may be used to identify any analogue or digital signal forming part of a signal path from an input to an output of the hearing aid.

Signal processing in the new hearing aid and in the new fitting instrument may be performed by dedicated hardware or may be performed in a signal processor, or performed in a combination of dedicated hardware and one or more signal processors.

As used herein, the terms "processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

A hearing aid includes: a first module accommodating first circuitry; a second module accommodating second circuitry; and an interconnecting member configured for interconnecting the first circuitry with the second circuitry; wherein the second circuitry comprises a memory for storing data relating to a configuration of the second module including the second circuitry, and data communication circuitry configured for transmission of the data relating to the configuration from the memory to the first circuitry.

Optionally, the first circuitry comprises a radio for wireless communication.

Optionally, the radio is connected to a conductor accommodated in the interconnecting member, the conductor being at least a part of an antenna.

Optionally, the second circuitry includes a power supply that is powered from the first circuitry.

Optionally, the power supply is powered utilizing a conductor accommodated in the interconnecting member, the conductor being at least a part of an antenna.

Optionally, the data communication circuitry is configured for signal transmission via the conductor.

Optionally, the second circuitry includes a receiver, and the receiver is connected to the first circuitry through separate signal conductors.

Optionally, the data stored in the memory includes an identifier of one or more components of the second circuitry.

Optionally, the data stored in the memory includes a plurality of identifiers of respective components of the second circuitry.

Optionally, the first module comprises a behind-the-ear housing, and the second module comprises an in-the-ear housing.

A fitting instrument for the hearing aid that is configured for reception of the data stored in the memory.

Optionally, the fitting instrument is configured for fitting the hearing aid based on the data stored in the memory.

Optionally, the fitting instrument is configured for displaying a message in response to the data stored in the memory.

A method of configuring a hearing aid is provided. The hearing aid includes: a first module accommodating first circuitry; a second module accommodating second circuitry; and an interconnecting member configured for interconnecting the first circuitry with the second circuitry, the interconnecting member accommodating a conductor that is at least a part of an antenna; wherein the second circuitry comprises a memory for storing data relating to a configuration of the second module including the second circuitry, and data communication circuitry configured for transmission of the data relating to the configuration from the memory to the first circuitry. The method includes: sending the data stored in the memory of the second circuitry; transmitting the data utilizing the conductor that is at least a part of the antenna; and receiving the data by the first circuitry.

Other and further aspects and features will be evident from reading the following detailed description of embodiments.

BRIEF DESCRIPTION OF THE DRAWINGS

Below, the novel method, hearing aid, and fitting instrument are explained in more detail with reference to the drawings in which various examples are shown. In the drawings.

DETAILED DESCRIPTION

Figure 1:
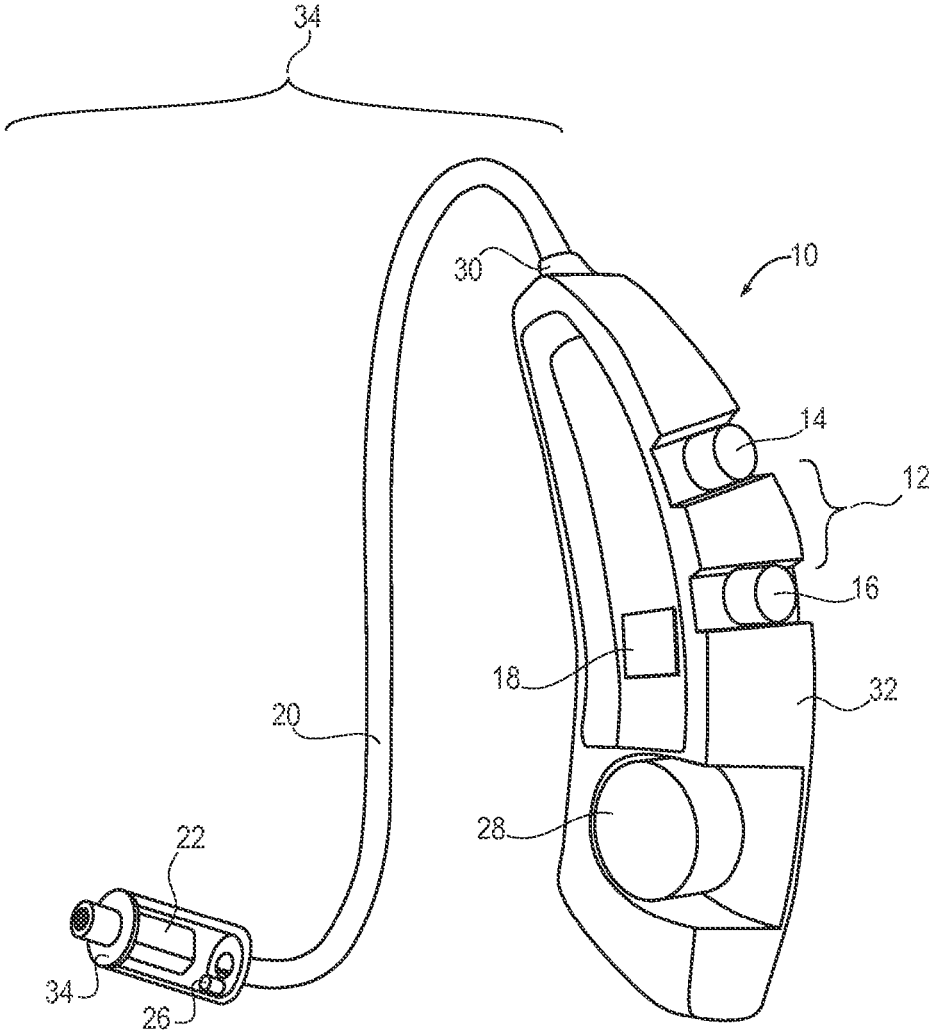
FIG. 1 schematically illustrates an exemplary novel hearing aid.

The novel method, hearing aid, and fitting instrument will now be described more fully hereinafter with reference to the accompanying drawings, in which various examples of the novel method, hearing aid, and fitting instrument are shown. The novel method, hearing aid, and fitting instrument may, however, be embodied in different forms and should not be construed as limited to the examples set forth herein.

It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Like reference numerals refer to like elements throughout. Like elements will, thus, not be described in detail with respect to the description of each figure.

FIG. 1 schematically illustrates a RIE hearing aid 10 comprising a first module 32 including a BTE hearing aid housing (not shown—outer walls have been removed to make internal parts visible) to be worn behind the pinna 100 of a user. The illustrated first module 32 accommodates first circuitry 12 with two BTE sound input transducers 14, 16, namely a front microphone 14 and a rear microphone 16, for conversion of an acoustic sound signal into respective microphone audio sound signals, optional pre-filters (not shown) for filtering the respective microphone audio sound signals, A/D converters (not shown) for conversion of the microphone audio sound signals into respective digital microphone audio sound signals that are input to a processor 18 configured to generate a hearing loss compensated output signal based on the input digital audio sound signals.

The hearing loss compensated output signal is transmitted through conductors 44 and 46, see (not visible) accommodated in an interconnecting member 20 to a receiver 22 of a second circuitry 24 accommodated in a second module 34 including the earpiece (outer walls have been removed to make internal parts visible). The receiver 22 provides an acoustic output signal for transmission towards the eardrum of the user based on the hearing loss compensated output signal. The second module 34 comprises the earpiece 62, see FIG. 2, with an outer shape that is configured to be comfortably positioned in the ear canal of the user for fastening and retaining the receiver 22 and the interconnecting member 20 in their intended positions in the ear canal of the user as is well-known in the art of BTE hearing aids.

The interconnecting member 20 comprises a connector 30 for easy connection and removal of the second module 34 with the earpiece 62 to and from the first module 32 with the BTE housing.

The second module 34 comprises the earpiece 62 and the interconnecting member 20 with the connector 30, and the earpiece 62 and the interconnecting member 20 with the connector 30 are supplied as one unit. A large number of different earpieces may be connected to the first module 32 of the BTE housing with the connector 30, such as earpieces accommodating f) one receiver and zero microphones, g) one microphone and zero receivers, h) one receiver and one microphone positioned for preservation of directional cue, i) one receiver and one microphone positioned for suppressing occlusion, j) one receiver and two microphones positioned for preservation of directional cue and suppressing occlusion, etc.

The earpieces may further be provided with receivers with different power ratings, e.g. 4 different ratings, and may further have interconnecting members 20 of different lengths, e.g. 5 different standard lengths.

Still further, earpieces may be provided configured for the left ear and earpieces may be provided configured for the right ear.

Yet still further, some earpieces may be provided with other sensors, such as temperature sensors, pressure sensors, directional sensors, etc.

Thus, a large variety of ear pieces may easily be provided; and thus, automatic detection of the configuration of second module 34 actually connected to the BTE housing with the connector 30 is highly advantageous, e.g. in order to avoid mistakes.

The earpiece 62 shown in the figures accommodates one In-the-Ear (ITE) microphone 26 that is positioned at the entrance to the ear canal when the earpiece 62 is positioned in its intended position in the ear canal of the user. The ITE microphone 26 is connected to an A/D converter (not shown) and optionally to a pre-filter (not shown) in the BTE housing, with interconnecting conductors (not visible) accommodated in the interconnecting member 20.

The BTE hearing aid 10 is powered by battery 28. The battery 28 may be rechargeable.

In use, the ITE microphone 26 is positioned at an entrance to an ear canal of the user. In this position, the output signal of the ITE microphone 26, in the following denoted the ITE audio sound signal, generated by the ITE microphone 26 in response to acoustic sound received by the ITE microphone 26, preserves spatial cues of the received acoustic sound signal; or, in other words, the ITE microphone 26 is positioned so that its transfer function constitutes a good approximation to the Head Related Transfer Functions of the user.

The processor 18 conveys the directional information contained in the ITE audio sound signal to the hearing loss compensated output signal thereby also preserving spatial cues so that the user maintains his or her localization capability.

The ITE microphone 26 operates proximate the receiver 22 so that risk of feedback is high, which limits the maximum stable gain available with the hearing aid 10 when the ITE audio sound signal is reproduced by the receiver 22.

However, in the hearing aid 10, output signals of the microphones 14, 16 and the ITE microphone 26 are subjected to signal processing, e.g. adaptive filtering as for example explained in more detail in European patent application No.: 12199761.3, in such a way that spatial cues are preserved and conveyed to the user of the hearing aid while feedback is simultaneously suppressed.

As mentioned above, a microphone may also be accommodated in the second module 34, i.e. in the earpiece 62, for suppressing occlusion. The microphone is positioned inside the ear canal proximate the ear drum when the earpiece 62 is positioned in its intended position in the ear canal of the user.

Typically, occlusion of the ear canal by the earpiece leads to an altered user perception of the user's own voice.

Sounds originating from the vocal tract (throat and mouth) are transmitted into the ear canal through the cartilaginous tissue between these cavities and the outer portion of the ear canal.

When nothing is positioned in the ear canal, most of this predominantly low frequency sound simply escapes from the ear canal. However, when the ear canal is blocked these bone-conducted sounds cannot escape from the ear canal. The result is a build-up of high sound pressure levels in the residual ear canal volume. This increase in low frequency sound pressure is audible and will cause them to hear their own voice as loud and boomy. Change in perception of own voice is the most dominant occlusion related complaint, but not the only one. Other occlusion related problems include too much amplification at low frequencies for hearing aid users with good low frequency hearing, reduced speech intelligibility, poorer localization, physical discomfort and increased risk of external ear irritation and infection. Hearing aid users do not adapt to occlusion and the occlusion effect has been cited by as many as 27% of hearing aid wearers as a reason for dissatisfaction with their hearing aids. This emphasizes the need for alleviating or, even better, eliminating the occlusion effect.

As explained in more detail in EP 2 434 780 A1, the receiver may compensate for the body conducted sound based on an output signal of the microphone positioned proximate the ear drum when the earpiece is positioned in its intended position in the ear canal of the user, so that the user perceives to listen to the hearing loss compensated signal only, whereby the occlusion effect is suppressed.

Figure 2:
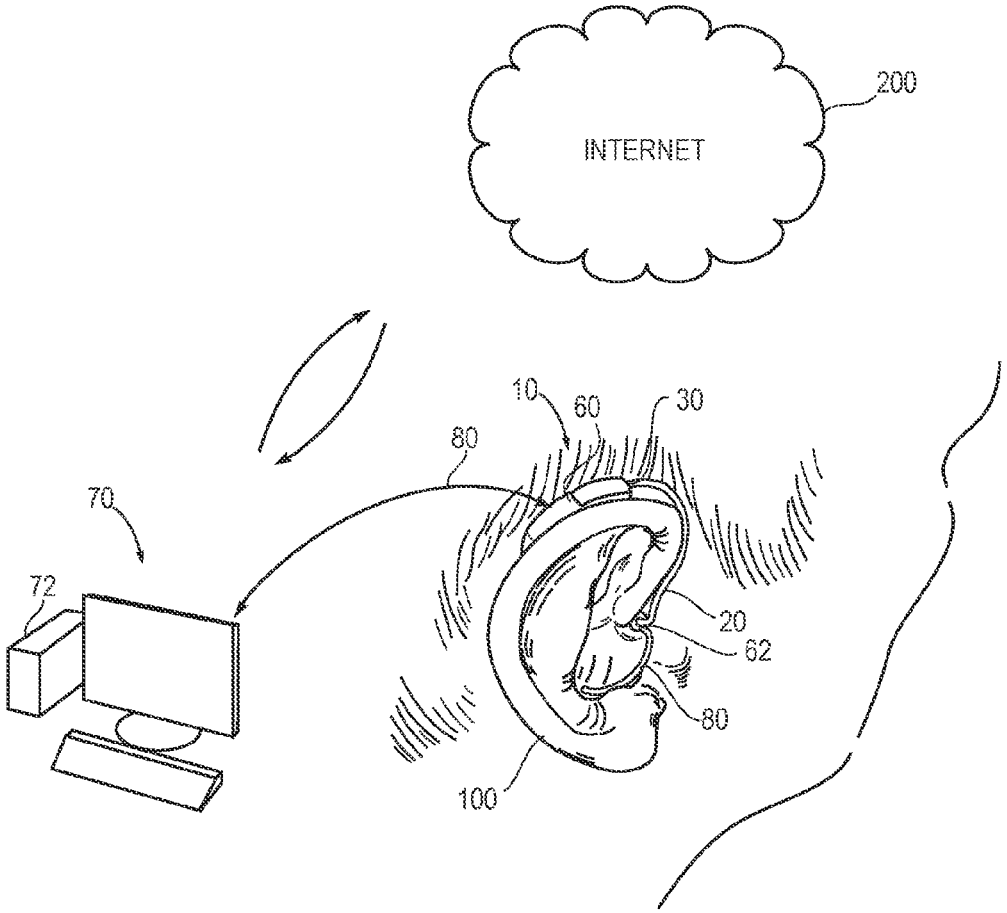
FIG. 2 shows in perspective a novel RIE hearing aid.

FIG. 2 shows the novel hearing aid 10 in its operating position with the BTE housing 60 behind the ear, i.e. behind the pinna 100, of the user. As illustrated, the novel hearing aid 10 may have an arm 64 that is flexible and intended to be positioned inside the pinna 100, e.g. around the circumference of the conchae behind the tragus and antitragus and abutting the antihelix and at least partly covered by the antihelix for retaining the earpiece 62 in its intended position inside the outer ear of the user. The arm may be pre-formed during manufacture, preferably into an arched shape with a curvature slightly larger than the curvature of the antihelix, for easy fitting of the arm into its intended position in the pinna 100.

FIG. 2 also schematically illustrates a novel fitting instrument 70 and its wireless interconnections with the Internet 200 and the new BTE hearing aid 10 shown in its operating position with the BTE housing 60 behind the ear, i.e. behind the pinna 100, of the user.

Data relating to the configuration may be transmitted wirelessly 80 to the fitting instrument 70, e.g. to be displayed on a display of the fitting instrument 70 for verification by the operator of the fitting instrument 70, and possible corrective action in the event that the detected type of earpiece is not of the desired type.

The fitting instrument 70 is configured for fitting the hearing aid 10 in accordance with the data relating to the configuration.

The fitting instrument 70 has a processor 72 that is configured for responding to the data relating to the configuration received from the hearing aid 10.

The fitting instrument may be configured to access a remote server through the Internet 200, e.g. to access a data base for further information on the hearing aid 10, e.g. based on the received data relating to the configuration, e.g. with new values of fitting parameters relating to a new type of earpiece 62.

Figure 3:
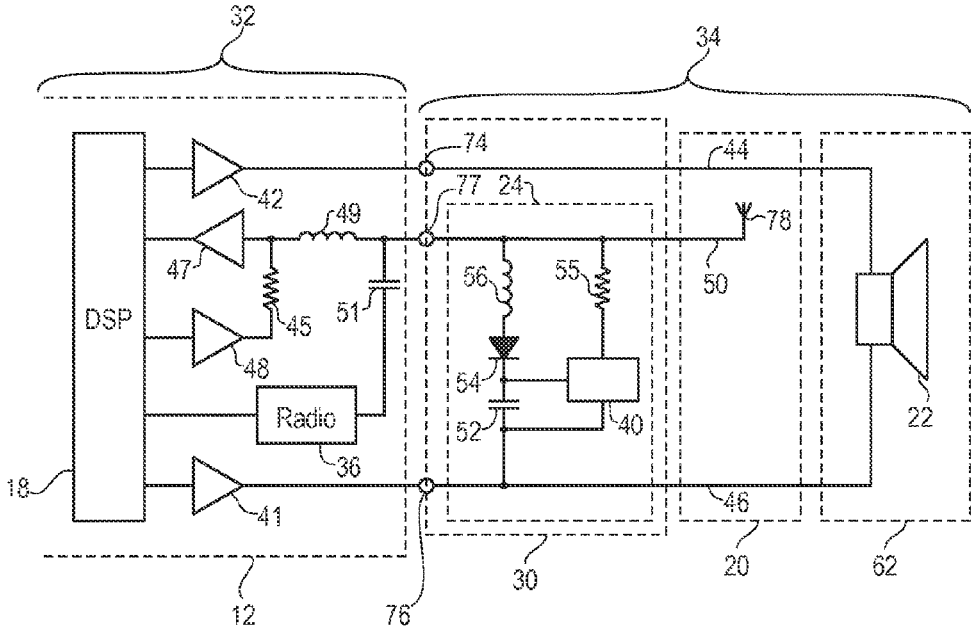
FIG. 3 shows hearing aid circuitry for automatic configuration detection.

FIG. 3 shows a block diagram of the first circuitry 12 and the second circuitry 24 for automatic configuration detection. In FIG. 3, the second circuitry 24 is accommodated in the connector 30; however, in another example, the second circuitry 24 may be accommodated in the earpiece 62. The first circuitry 12 is accommodated in the BTE housing.

The interconnecting member 20 accommodates three conductors 44, 46, 50; two of which 44, 46 transmit the hearing loss compensated audio signal to the receiver 22 as a balanced signal. The receiver 22 is driven by a first receiver driver 42 and a second receiver driver 41 of the first circuitry 12 accommodated in the BTE-housing 60. During normal operation of the hearing aid 10, the receiver drivers 41, 42 transmits the hearing loss compensated sound signal to the receiver as a balanced signal utilizing conductors 44 and 46 accommodated in the interconnecting member 20.

The second circuitry 24 comprises a microcontroller 40 with a non-volatile memory for storing data relating to a configuration of the second module 34 including the second circuitry 24, such as data that uniquely identifies component (s) of the second module 34 to the circuitry 12 of the first module 32, including the type of ear piece 62, the type of receiver 22 and possible other components of the second circuitry 24. The transmitted data contains, e.g., the power rating of the receiver 22, whether the ear piece 62 is for the left ear or the right ear, and possibly the length of the interconnecting member 20, and possibly the number and types (occlusion and/or spatial cue) of microphones 26 of the second circuitry, and possibly the number and types of other sensors of the second circuitry, etc.

The microcontroller 40 also comprises data communication circuitry configured for transmission of the data relating to the configuration from the memory to an input transceiver 47 of the first circuitry 12, the input transceiver 47 providing the received data signals to the processor 18 of the first circuitry 12 and the processor 18 is configured for adjusting operating parameters of the hearing aid based on the data relating to the configuration. The data communication circuitry of the microcontroller 40 is also configured for reception of data provided by the processor 18 and conveyed to the microcontroller 40 via an output transceiver 48, including data to be stored in the non-volatile memory, such as data relating to the configuration, and commands to the microcontroller 40 for performing certain operations, such as perform a transmission of the data relating to the configuration.

In FIG. 3, the microcontroller 40 is configured for transmission of the data relating to the configuration to the first circuitry 12 at power up of the hearing aid. During boot of the circuitry 12 at power up of the hearing aid 10, the output transceiver 48 of the first circuitry 12 transmits a high frequency signal, preferably of a frequency above 20 kHz, to the second circuitry 24 utilizing conductor 50. The high frequency signal charges the second capacitor 52 through rectifier 54, and the charged second capacitor 52 subsequently supplies power to the microcontroller 40 during transmission of the data relating to configuration to the circuitry 12 also utilizing conductor 50.

The microcontroller 40 is configured for detection of presence of the high frequency signal. The microcontroller 40 is further configured for transmission of the data on conductor 50 upon secure detection of the high frequency signal.

In another example, the microcontroller 40 may be configured for transmission of the data relating to the configuration upon the hearing aid 10 receiving a user request for transmission of the data relating to the configuration, from a user interface, e.g. a wireless user interface, of the hearing aid 10; and/or upon the hearing aid 10 receiving a request for transmission of the data relating to the configuration, from external equipment, such as a fitting instrument 70.

The microcontroller 40 may be configured to transmit the data related to configuration of the second module 34 repeatedly until power is no longer available from the capacitor 52, or, the microcontroller 40 may be configured to transmit the data relating to configuration repeatedly until receipt of an acknowledge signal from the first circuitry 12 that the data has been successfully received, e.g. by emission of the high frequency signal for a predetermined time period.

The first circuitry 12 comprises a radio 36 that is connected to conductor 50 of the interconnecting member 20 that functions as a first part of a dipole antenna 78 with a second part (not shown) of the dipole antenna residing in the first module 32. A second inductor 56 is positioned in the second circuitry 24 between the rectifier 54 and the second capacitor 52 in order to prevent the high-frequency radio transmissions sharing conductor 50 from inadvertently powering up the microcontroller 40 while using the radio 36.

The conductor 50 is also used for transmission of the data relating to the configuration and for charging of the capacitor 52 that constitutes the power supply of the second circuitry 24. The conductor 46 is used as the reference conductor for the second circuitry 24 during charging of the second capacitor 52 and during transmission of the data. Thus, transmission of the audio signal to the receiver 22 is not performed simultaneously with charging of the capacitor 52 or with transmission of the data relating to the configuration. This may e.g. be realized by putting the first receiver driver 42 and the second receiver driver 41 in a high impedance, tri-state mode during transmission of the data relating to the configuration.

The second circuitry 24 includes a power supply comprising rectifier 54 and capacitor 52 that is charged by the signal from the output transceiver 48 of the first circuitry 12.

The capacitor 52 is charged utilizing conductors 50 and 46 with the conductor 50 as the active conductor and the conductor 46 as the reference conductor as described in the foregoing. For example, the capacitor 52 is charged by transmitting a high frequency signal f>20 kHz on the conductors 50, 46, providing a rapidly alternating current through the second inductor 56 and the rectifier 54, thus charging the capacitor 52 to a stable voltage suitable for powering the microcontroller 40.

Figure 4:
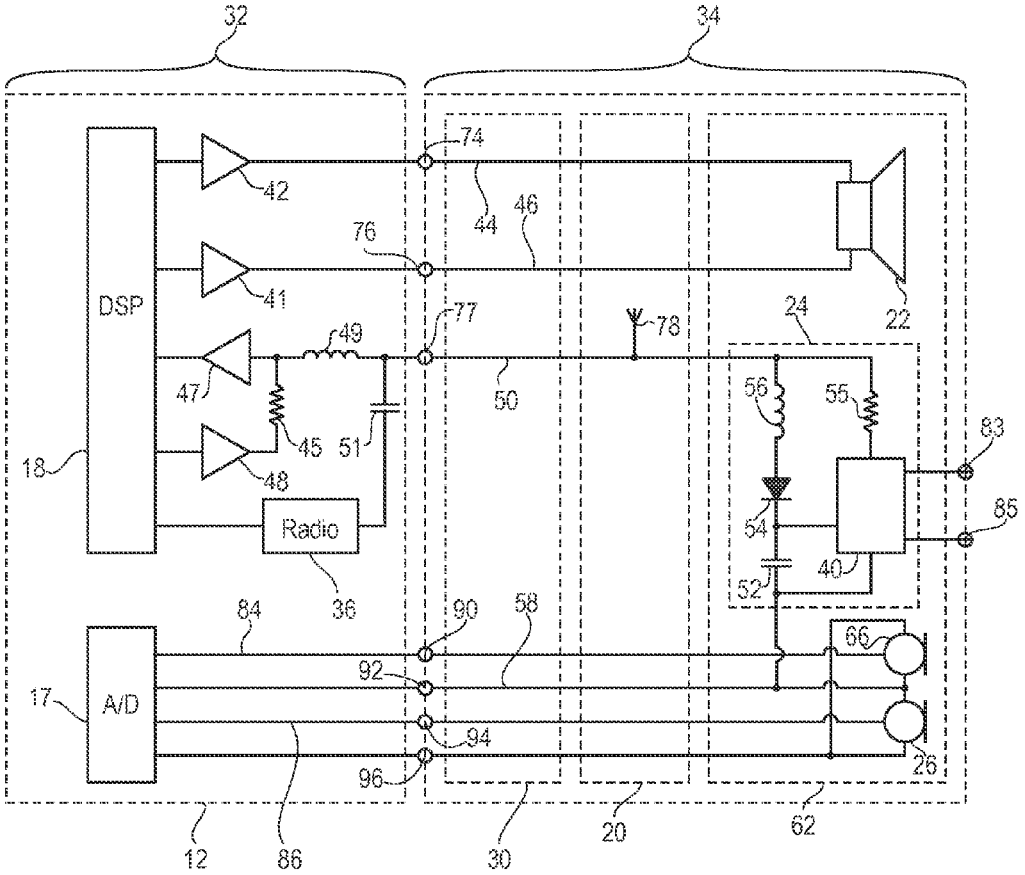
FIG. 4 shows another hearing aid circuitry for automatic configuration detection.

FIG. 4 shows a block diagram of the first circuitry 12 and another second circuitry 24 for automatic configuration detection similar to the first circuitry 12 and second circuitry 24 shown in FIG. 3 except for the fact that a different conductor 58 that is used as the reference conductor together with conductor 50 for transmission of the data and for charging of the capacitor 52 so that the hearing loss compensated sound signal may be transmitted to the receiver 22 simultaneous with transmission of the data or with charging of the capacitor 52. The second circuitry 24 is disposed in the second module 34. Except for the fact that further components are provided in the second module 34, namely microphones 66, 26 used for suppressing the occlusion effect and for recording directional cues, respectively, and two connectors 83, 85 for medical sensors, such as e.g. a temperature sensor and a blood pressure sensor. The data stored in the non-volatile memory of the microcontroller 40 identifies all of these components. The two microphones 66, 26 are connected to an A/D converter 17 in the first circuitry 12 of the first module 32 via signal conductors 84, 86 respectively, and also receives power from the A/D converter 17 via the power conductor 59.

Figure 5:
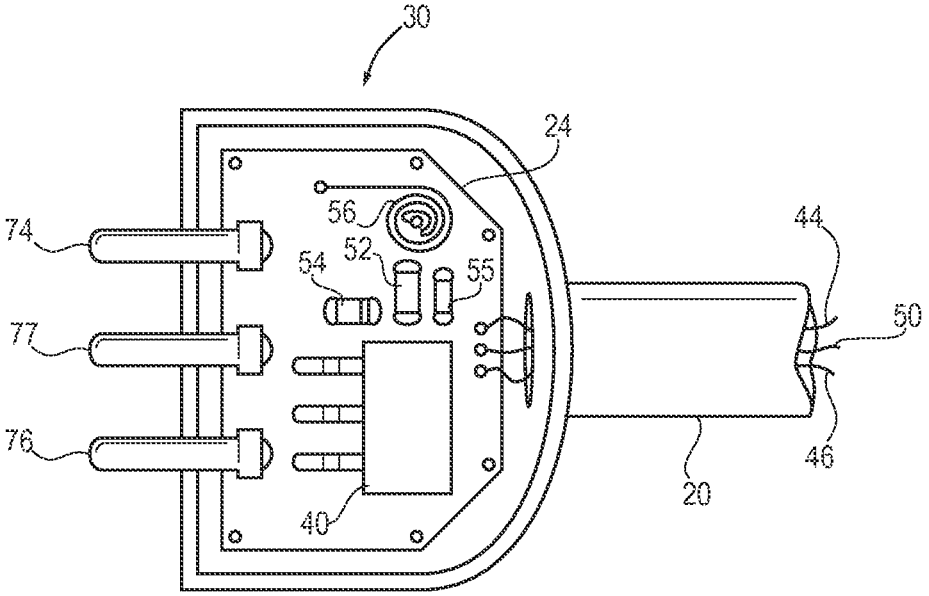
FIG. 5 shows a plug for a hearing aid comprising circuitry for automatic configuration detection.

FIG. 5 shows an exemplary embodiment of a connector 30 having circuitry 24 for automatic configuration detection for a hearing aid in a manner similar to the schematic block diagram shown in FIG. 3. The housing of the connector 30 is partly taken apart in order to disclose the circuitry 24 disposed within. The automatic configuration circuitry comprises (not shown to scale) the microcontroller 40 and associated, peripheral components; second inductor 56, rectifier 54, capacitor 52 and resistor 55, e.g. embodied as surface-mounted components or other components of comparatively modest size. Also shown is first connection point 74, second connection point 76 and third connection point 77 embodied as male plug pins embedded in the connector 30. The male plug pins are configured for matingly connecting the circuit 24 electrically to the first module 32. Also shown is a part of interconnecting member 20, severed for visibility of the embedded conductors 44, 46 providing electrical connections to the receiver 22 of the ear piece 62 and the conductor 50 providing electrical connection to the antenna 78.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents, as defined by the claims.

The invention claimed is:

1. A hearing aid comprising:

a first module comprising first circuitry;

a second module comprising second circuitry having a power supply; and an interconnecting member configured for interconnecting the first circuitry with the second circuitry, wherein the interconnecting member comprises an elongate cable, at least a part of the elongate cable configured for placement around a part of an ear;

wherein the second circuitry comprises a memory for storing data relating to a configuration of the second module including the second circuitry, and data communication circuitry configured for providing the data relating to the configuration for transmission to the first circuitry; and wherein the elongate cable is configured to both (1) transmit a hearing loss compensated signal from the first circuitry to the second circuitry, and (2) transmit a signal for charging the power supply in the second circuitry.

2. The hearing aid according to claim 1, wherein the first circuitry comprises a radio for wireless communication.

3. The hearing aid according to claim 2, wherein the radio is connected to a conductor accommodated in the interconnecting member, the conductor being at least a part of an antenna.

4. The hearing aid according to claim 1, wherein the signal for charging the power supply comprises a frequency signal.

5. The hearing aid according to claim 1, wherein the power supply is powered utilizing a conductor accommodated in the interconnecting member, the conductor being at least a part of an antenna.

6. The hearing aid according to claim 1, wherein the data communication circuitry is configured for signal transmission via a conductor in the elongate cable.

7. The hearing aid according to claim 1, wherein the second circuitry includes a receiver, and the receiver is connected to the first circuitry through separate signal conductors in the elongate cable.

8. The hearing aid according to claim 1, wherein the data stored in the memory includes an identifier of one or more components of the second circuitry.

9. The hearing aid according to claim 1, wherein the first module comprises a behind-the-ear housing, and the second module comprises an in-the-ear housing.

10. A fitting instrument for a hearing aid according to claim 1, configured for reception of the data stored in the memory.

11. The fitting instrument according to claim 10, configured for fitting the hearing aid based on the data stored in the memory.

12. The fitting instrument according to claim 11, configured for displaying a message in response to the data stored in the memory.

13. A method of configuring a hearing aid, the hearing aid comprising:

a first module comprising first circuitry;

a second module comprising second circuitry; and an interconnecting member configured for interconnecting the first circuitry with the second circuitry, the interconnecting member accommodating a conductor that is at least a part of an antenna; wherein the second circuitry comprises a memory for storing data relating to a configuration of the second module including the second circuitry, and data communication circuitry configured for transmission of the data relating to the configuration from the memory to the first circuitry;

wherein the method comprises:

obtaining the data stored in the memory of the second circuitry;

transmitting the data relating to the configuration of the second module utilizing the interconnecting member; and receiving the data by the first circuitry;

wherein the interconnecting member comprises a cable configured to both (1) transmit an electrical signal from the first circuitry to the second circuitry, and (2) transmit a microphone signal from the second circuitry to the first circuitry.

14. The hearing aid according to claim 1, wherein the second module is a part of an earpiece that includes a first microphone and a speaker.

15. The hearing aid according to claim 14, wherein the earpiece includes a second microphone.

16. The hearing aid according to claim 1, further comprising an antenna between the first circuitry and the second circuitry.

17. The hearing aid according to claim 1, further comprising a connector at one end of the interconnecting member, the connector configured to mate with another connector at the first module.

18. The hearing aid according to claim 1, wherein the power supply comprises a rectifier.

19. The hearing aid according to claim 1, wherein the power supply comprises a capacitor.

20. A hearing aid comprising:

a first module comprising first circuitry;

an earpiece; and an interconnecting member configured for connecting the earpiece to the first module via a connector at one end of the interconnecting member;

wherein the connector comprises second circuitry;

wherein the second circuitry comprises a memory for storing data relating to a configuration of the earpiece, and wherein the second circuitry is configured to provide the data relating to the configuration of the earpiece for the first circuitry; and wherein the interconnecting member is configured to transmit a hearing loss compensated signal from the first circuitry to the earpiece.

21. The hearing aid according to claim 20, wherein the connector is configured to mate with another connector at the first module.

22. The hearing aid according to claim 20, wherein the first module comprises a BTE housing.

23. A The hearing aid according to claim 1, wherein the interconnecting member is configured to transmit a radio signal.

24. The hearing aid according to claim 20, wherein the earpiece comprises a receiver.

25. The hearing aid according to claim 20, wherein interconnecting member is also configured to transmit a frequency signal.

26. The hearing aid according to claim 20, wherein the interconnecting member is configured to operate as an antenna.

27. The hearing aid according to claim 1, wherein the elongate cable is configured to operate as an antenna.

28. The hearing aid according to claim 20, wherein the frequency signal is for charging a power supply in the earpiece.

* * * * *